US008935898B2

(12) United States Patent
Van Nest et al.

(10) Patent No.: US 8,935,898 B2
(45) Date of Patent: Jan. 20, 2015

(54) INTERFACE BRACKET FOR ATTACHMENT OF RECYCLABLE VESSELS AND ROOFING MATERIAL MADE USING SAME

(75) Inventors: Jason Van Nest, Old Westbury, NY (US); Farzana Gandhi, Old Westbury, NY (US); Michelle Bertomen, Old Westbury, NY (US)

(73) Assignee: New York Institute of Technology, Old Westbury, NY (US)

( * ) Notice: Subject to any disclaimer, the term of this patent is extended or adjusted under 35 U.S.C. 154(b) by 0 days.

(21) Appl. No.: 14/001,746

(22) PCT Filed: Mar. 6, 2012

(86) PCT No.: PCT/US2012/027863

§ 371 (c)(1),
(2), (4) Date: Sep. 30, 2013

(87) PCT Pub. No.: WO2012/122164

PCT Pub. Date: Sep. 13, 2012

(65) Prior Publication Data

US 2014/0007538 A1 Jan. 9, 2014

Related U.S. Application Data

(60) Provisional application No. 61/464,706, filed on Mar. 7, 2011.

(51) Int. Cl.

| | |
|---|---|
| ***E04D 1/34*** | (2006.01) |
| ***E04D 1/24*** | (2006.01) |
| ***B65D 71/50*** | (2006.01) |
| ***B65D 81/36*** | (2006.01) |

(52) U.S. Cl.

CPC .. *E04D 1/34* (2013.01); *E04D 1/24* (2013.01); *B65D 71/50* (2013.01); *B65D 81/36* (2013.01); *Y10S 52/09* (2013.01)

USPC ..... 52/543; 52/DIG. 9

(58) Field of Classification Search

CPC ..... E04D 1/24; E04D 1/34; E04D 2001/34; Y10S 52/09; B65D 81/36; B65D 81/361; B65D 81/365; B65D 71/50

USPC ..... 52/DIG. 9, 543, 27; 294/87.2, 159

See application file for complete search history.

(56) References Cited

U.S. PATENT DOCUMENTS

| | | | | | |
|---|---|---|---|---|---|
| 2,730,321 | A | * | 1/1956 | Dutton | 47/40.5 |
| 3,982,362 | A | | 9/1976 | Moore | |
| 4,057,946 | A | * | 11/1977 | Barrett | 52/436 |
| 4,068,429 | A | | 1/1978 | Moore | |
| 4,624,383 | A | | 11/1986 | Moore | |

(Continued)

OTHER PUBLICATIONS

"GreenovationTV", May 1, 2009, http://www.greenovationtv.com/2009/05/50-watt-lights-made-with-water-use-no-energy/.*

(Continued)

*Primary Examiner* — Ryan Kwiecinski

(74) *Attorney, Agent, or Firm* — Abelman, Frayne & Schwab

(57) ABSTRACT

The invention relates to an apparatus, e.g., a bracket, configured for reception of vessels, such as plastic bottles which have been cut in a way which makes them useful upon assembly, as roofing construction elements. The roofing elements, the roofing structures which result and kits for manufacturing these structures, are all features of the invention.

9 Claims, 6 Drawing Sheets

(56) References Cited

U.S. PATENT DOCUMENTS

| | | | | |
|---|---|---|---|---|
| 4,784,260 | A * | 11/1988 | Holben | 206/223 |
| 5,197,396 | A * | 3/1993 | Breezer et al. | 108/56.3 |
| 5,513,696 | A * | 5/1996 | Baer | 165/10 |
| 5,675,954 | A | 10/1997 | Garcia | |
| 6,161,355 | A * | 12/2000 | Gratt | 52/561 |
| 6,907,703 | B2 | 6/2005 | Gonzalez | |
| 7,066,330 | B1 * | 6/2006 | Lashley | 206/480 |
| 7,644,828 | B1 * | 1/2010 | Klein | 215/10 |
| 2002/0108335 | A1 | 8/2002 | Haddock | |
| 2005/0051548 | A1 * | 3/2005 | Erel | 220/23.4 |
| 2007/0231084 | A1 * | 10/2007 | Price et al. | 405/288 |
| 2010/0122504 | A1 | 5/2010 | Sarkisian et al. | |
| 2010/0129667 | A1 | 5/2010 | Kalkanoglu et al. | |

OTHER PUBLICATIONS

"Use a 2-Liter Bottle as a 50 Watt Light Bulb lightbulb hack", May 8, 2008, http://www.youtube.com/watch?v=_zMAWztZ6TI.*

Yoneda, Yuka Volunteers Recycle 7000 Plastic Bottles into a Colorful Shingled Roof. [Online], Jan. 4, 2011 [retrieved on May 25, 2012].

International Search Report for PCT/US2012/27863 dated May 25, 2012 (3 pages).

* cited by examiner

Figure $2a_1$
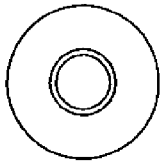
Figure $2b_1$
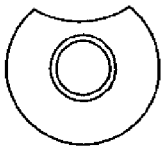
Figure $2c_1$
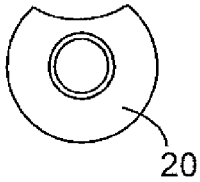
Figure $2a_2$
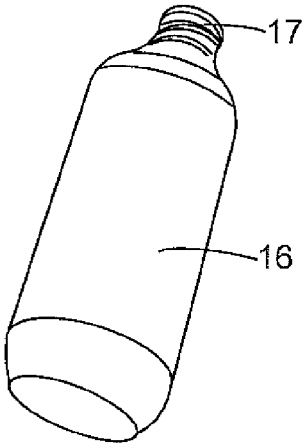
Figure $2b_2$
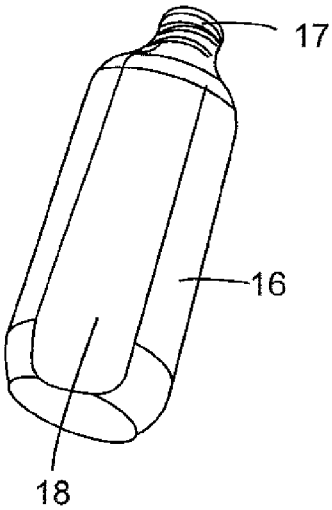
Figure $2c_2$
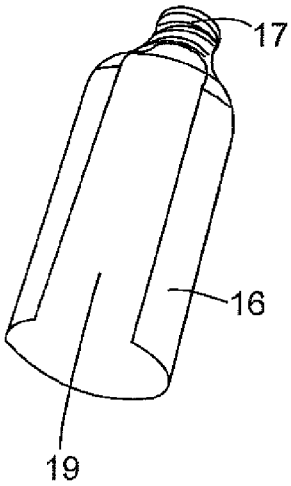

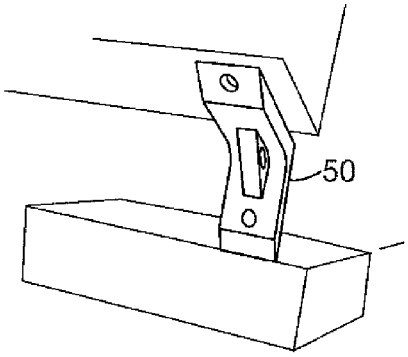
Figure 5a
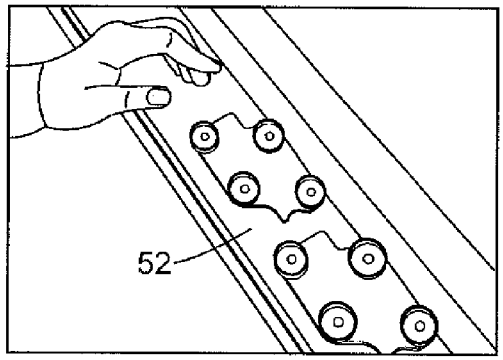
Figure 5c
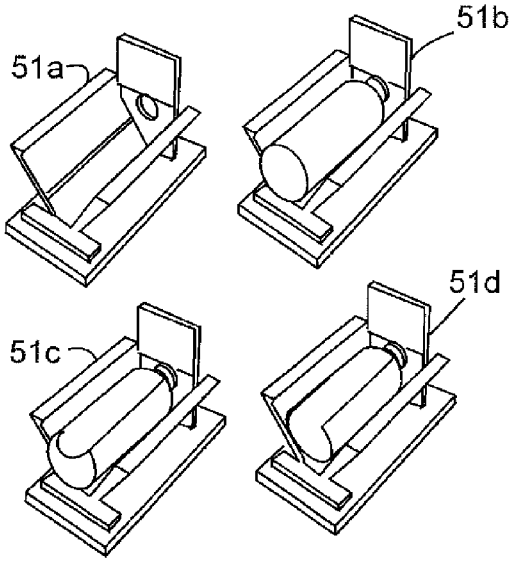
Figure 5b
Figure 5d
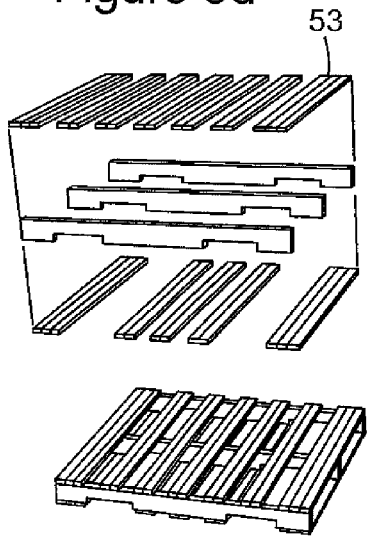

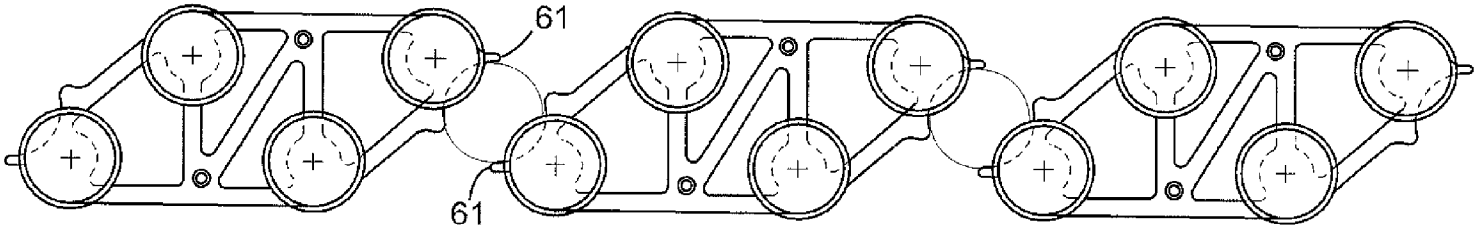
Figure 6a
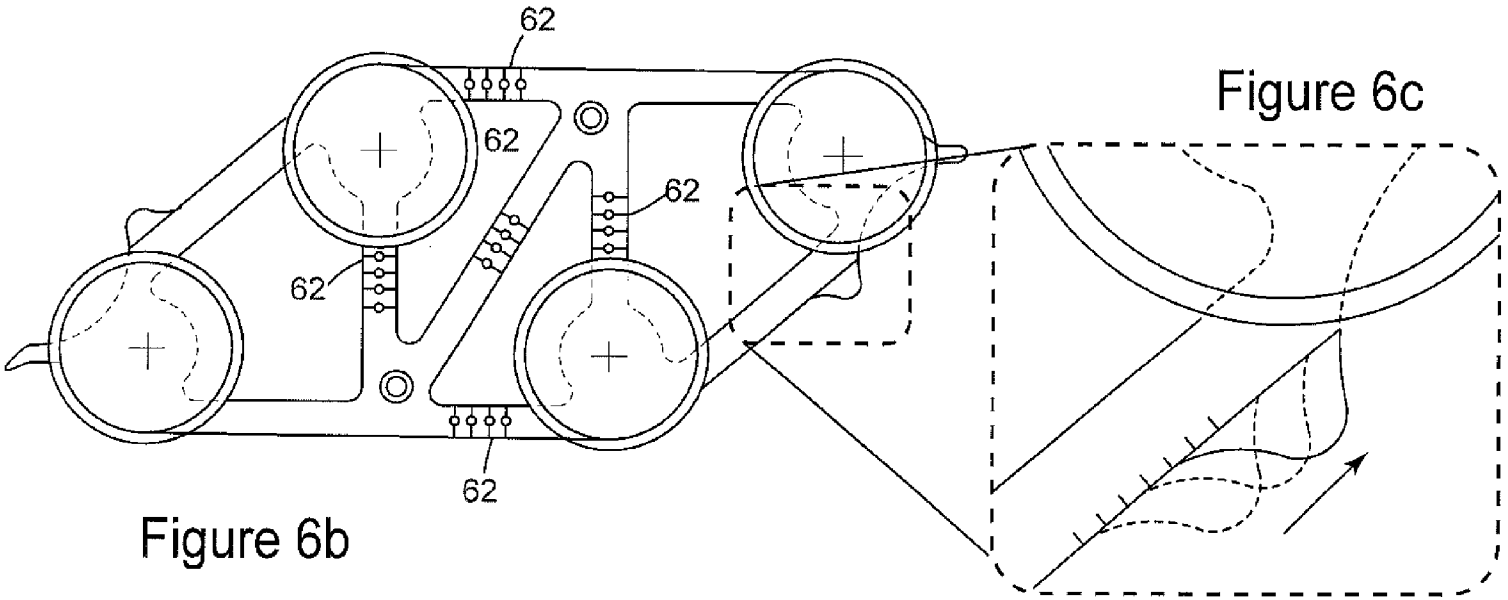
Figure 6c
Figure 6b

INTERFACE BRACKET FOR ATTACHMENT OF RECYCLABLE VESSELS AND ROOFING MATERIAL MADE USING SAME

RELATED APPLICATION

This application is a §371 of PCT/US2012/027863 filed Mar. 6, 2012, and claims priority of U.S. Provisional Patent Application No. 61/464,706, filed Mar. 7, 2011, and incorporated by reference in its entirety.

This invention relates to an interface bracket useful in constructing roofing devices made of recyclable materials, such as bottles or other vessels. It also relates to the roofing materials thus made.

BACKGROUND AND PRIOR ART

The inventors are not the first investigators to have addressed the issue of inexpensive building materials made of used recyclable materials. See, e.g., www.inhabitat.com, "The Fizzy Bottle Roof Projection," www.united-bottle.org, and www.eco-technologia.com for examples of other approaches to this concept. Also note the inventors' work on www.sodabib.org.

Interest in using discarded, post-consumer materials as building supplies is evidenced via, e.g., U.S. Pat. Nos. 6,161,355; 4,068,429; and 3,982,362, which describe the use of cans for manufacturing walls, storage systems, temporary shelters, and so forth. U.S. Pat. No. 5,675,954 evidences use of discarded tires in roofing structures.

Interest in using discarded, post-consumer bottles in construction is seen in, e.g., U.S. Pat. Nos. 6,907,703; 4,624,383; and 4,057,946. These patents essentially describe structural modifications to bottles and other liquid container means, such that these may interlock with each other to form large, stable structures. Published patent application 2010/0122504 teaches structures which can employ waste materials as so-called "form inclusion" materials.

None of these references, however, disclose structures or methods for producing relatively light weight roofing materials which can be constructed of waste materials, e.g., vessels for liquid containment, such as plastic bottles, or structures which can be used to facilitate the manufacture of these structures.

The invention as described herein provides a universal building attachment system which allows for the simple, rapid building of durable roofs that may be adjusted for the needs of a particular climate. It provides a practical alternative to other makeshift systems, such as asbestos ridden corrugated tin roofs. These suffer from various disadvantages, including overheating, and the use of hazardous material.

Figure 1B:
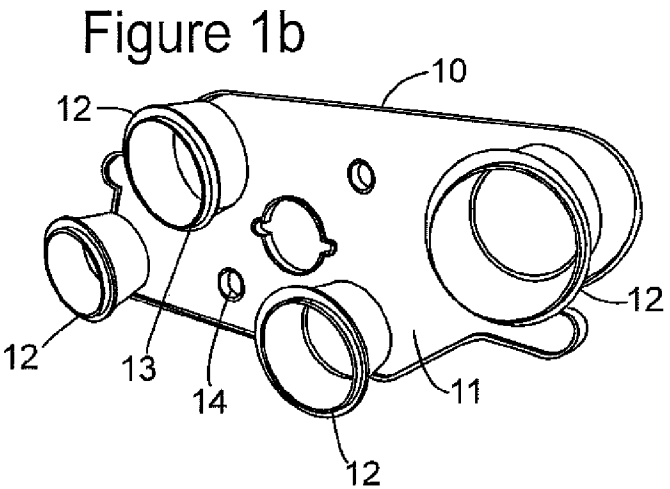
FIGS. 1*a*-1*d* depict different embodiments of the bracket means of the invention and its deployment in components of roofing structures.

FIGS. $\mathbf{2}a_1$, $\mathbf{2}b_1$, $\mathbf{2}c_1$, $\mathbf{2}a_2$, $\mathbf{2}b_2$ and $\mathbf{2}c_2$ show details as to how disposable vessels are prepared and used in connection with the bracket means of FIG. 1.

FIGS. 3*a*-3*d* show the preparation of components of the roofing system of the invention in more detail.

FIGS. 4*a*-4*c* and 5*a*-5*d* all show elaboration of aspects of the invention.

FIGS. 6*a*-6*c* present embodiments of the B1B in greater detail, so as to show spacing between a plurality of the B1Bs, as well as adjustable means positioned on the BIB so as to permit adjustment for different vessel sizes.

DETAILED DESCRIPTION OF PREFERRED EMBODIMENTS

With reference to the figures, FIGS. 1*a*-1*d* displays a so-called "bottle interface brackets 10," which will be called a "BIB" hereafter. The bracket comprises a base 11 made of durable material, such as plastic, having attached thereto a plurality of nesting means, or mounts 12 each of which is adapted to receive a bottle or other vessel, as described infra. Preferably, the material is recyclable or made from recycled materials. The nesting means or mounts are configured so as to engage the vessels, such as bottles, via the commonly found threaded portion 13 thereof, e.g., their neck. The bracket also contains a plurality of fastening means 14, adapted to receive, e.g., standard screws, nails, bottle caps, or other fastening means to engage vessels to or with a permanent structure, such as a roofing purlin.

Figure 1D:
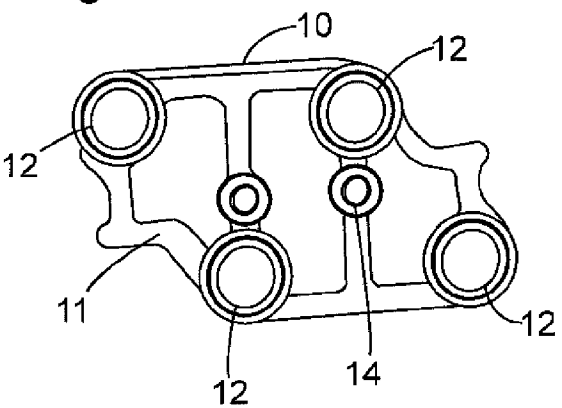
Figure 1A:
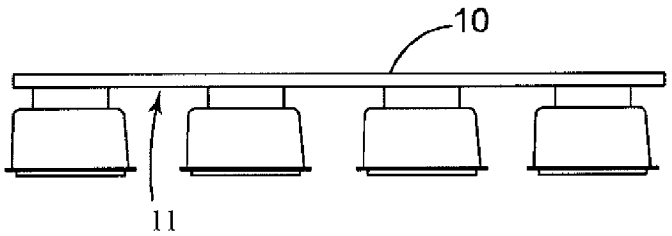

FIG. 1*a* depicts a plurality of interface brackets aligned on the base of a bottle interface bracket 11.

Figure 1C:
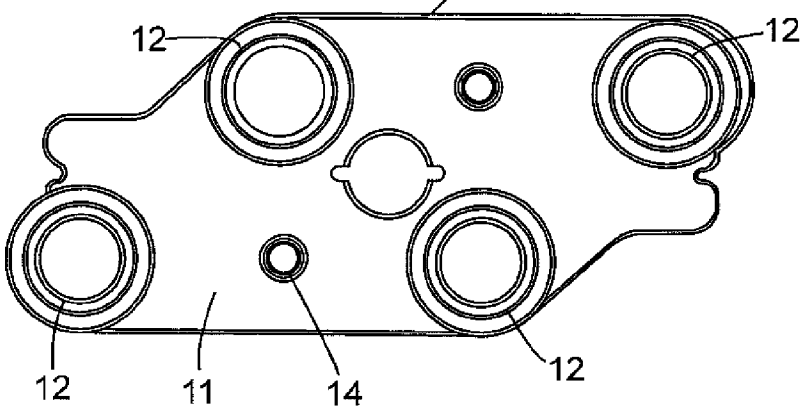

FIG. 1*b* shows one view of an embodiment of a BIB in accordance with the invention, while FIG. 1*c* shows the embodiment of FIG. 1*b* from another view point. FIG. 1*d* shows a second embodiment of the BIB.

FIGS. 2*a*-2*c* depicts how the vessel components are prepared for use in the invention. FIG. 2*a* shows an unprocessed member of the roofing apparatus, e.g., a standard plastic bottle 16, while FIGS. 2*b* and 2*c* show the standard cuts discussed infra. In practice, the vessels used for the roofing device must have a uniform neck portion 17. The diameter and shape of the vessels may vary as long as accommodated by the BIB. While there are standard sized bottles and necks, the BIBS of the invention may be configured for any size or style of bottle, and may contain any number of mounts. Especially preferred are BIBs with from 2-24 mounts, and those with 2-6 are especially preferred. A BIB with a sufficient number of mounts may in fact act as a support means itself.

Exemplary, but by no means the only potential embodiments of the invention are BIBs adapted to hold liter, half-liter, two liter, pint, quart, and half-gallon vessels, as well as other sizes which will be immediately apparent to the skilled artisan. Similarly, while the depicted BIB holds four vessels, it will be apparent to the artisan that the BIB may be configured to hold any number of vessels. In one, non-limiting embodiment, the threadings of the bracket are adapted to fasten to vessels closed by a standard bottle cap. Threadings may vary and include, e.g., standard threadings, such as those disclosed for "SPI Neck Finish Specification for Standard Closures," 400H, 410H, 415H, and other art recognized sizes.

The backing of the bracket is designed to reposition the threaded mounts at any number of adjustable intervals. The adjustments can reposition threading to be wider apart or closer together in the horizontal dimension. The adjustments can reposition threading to also be at different intervals in the vertical spacing as well. The adjustments are intended to allow the BIB to accommodate vessels between, e.g., 1½" and, 8" diameter, or larger.

To reposition threading to adjustable intervals, the lateral and vertical members have pre-set, adjustable means to adjust and lock BIB interval sizes quickly, as can be seen more clearly in FIG. 6.

Important to the function of the invention is the ability to align and space multiple BIBs rapidly along any flat roofing surface. To accommodate proper spacing of the BIBs, adjustable mounts on the side of the BIB can be set to frame a vessel's cap. Caps are used to space the BIBs at constant intervals. Spacing BIBs by cap sizes insures that rows of vessels are spaced evenly.

The vessels are washed and dried prior to use. Following this, half of the vessels in FIG. 2*a* receive one of a series of standard cuts 18, such as a single lateral cut, leaving the end opposite the neck intact. This is shown in FIG. 2*b*.

The other half of the bottles receive one of a series of standard cuts, such as a lateral cut 19 and a circular cut 20 to remove the bottom portion thereof, as shown in FIG. 2*c*.

Hereafter, the bottles prepared as shown in FIG. 2*b* will be referred to as the "top thatch" component and those of FIG. 2*c*, the "bottom thatch" component.

Figure 3A:
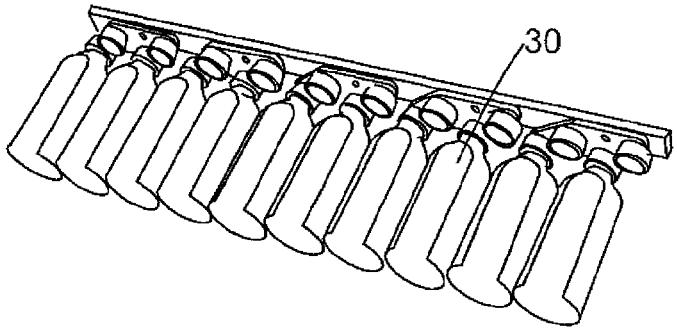

Following preparation of the top and bottom thatch components, they are attached to the BIB, as shown in FIGS. 3*a*-3*d*. The attachment can take place before or after attachment of the BIBs to a structure. Bottom thatch vessels are inserted in to the lower portion of the BIB with the cut out portion facing upwards 30, as shown in FIG. 3*a*.

If desired appropriate materials can be inserted into the cavity of the vessels, or be used to coat their interior or exterior before assembly. For a reflective roof, e.g., (to prevent green-house conditions within), reflective elements can be inserted in the vessels such as tin foil, aluminum foil, unwrapped cans, and so forth. Similarly, for an opaque roof (to darken conditions within), opaque elements can be inserted in the vessels, e.g., paint, papers, mud, etc. Paint, mud, and so forth may be used for coating the vessels, especially the bottom thatch vessels.

Figure 3B:
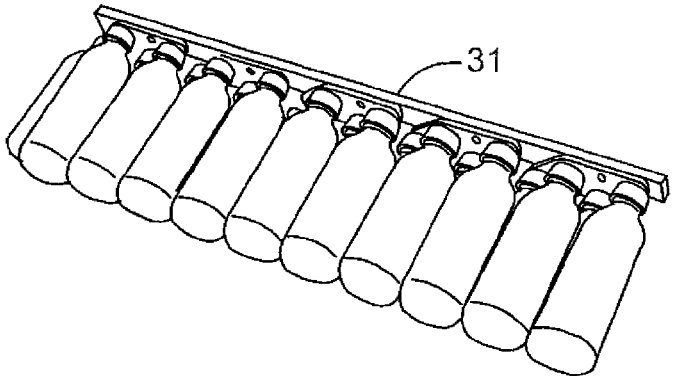
Figure 3C:
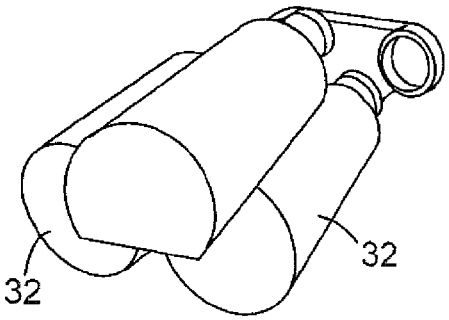
Figure 3D:
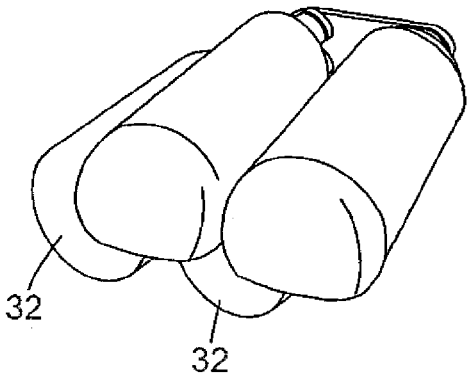

Following this, a first top thatch vessel is inserted in an upper mount of the BIB 31, as shown in FIG. 3*b*. Note that the BIB is angled such that when the top thatch bottle is inserted, it locks the two bottom thatch vessels in place. Adding a second top thatch bottle 32, as shown in FIGS. 3*c* and 3*d*, permits the user to lock bottom thatch members of adjoining BIBs in place.

Important to the functioning of the invention is the ability of the threaded mounts positioned in the BIB, to rotate freely. Also, these threaded mounts must be fixed to the depicted back plates. This configuration means that vessels, when attached, cannot and need not be turned. Then obviates any issue with the vessels needing to pass through each other in order to be threaded on to the BIBs. It should be noted, however, that only the top thatch mounting means must be attached to allow free rotation. If bottom thatch vessels are attached before the top thatch vessels, this may be done with rotation, without impeding other vessels.

Figure 4A:
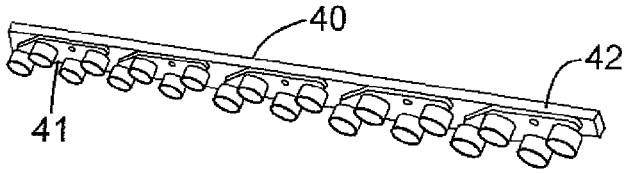
Figure 4B:
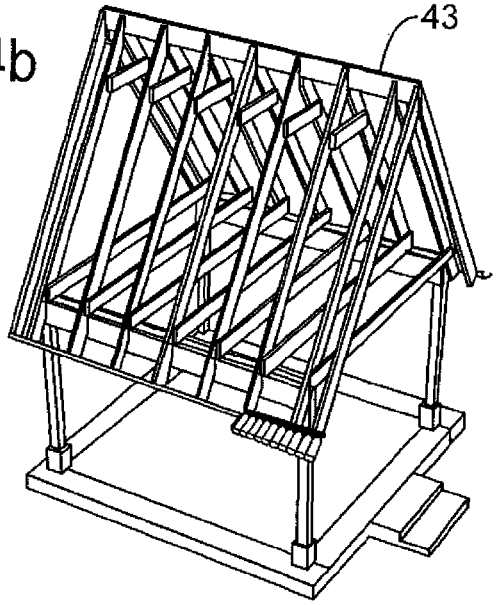
Figure 4C:
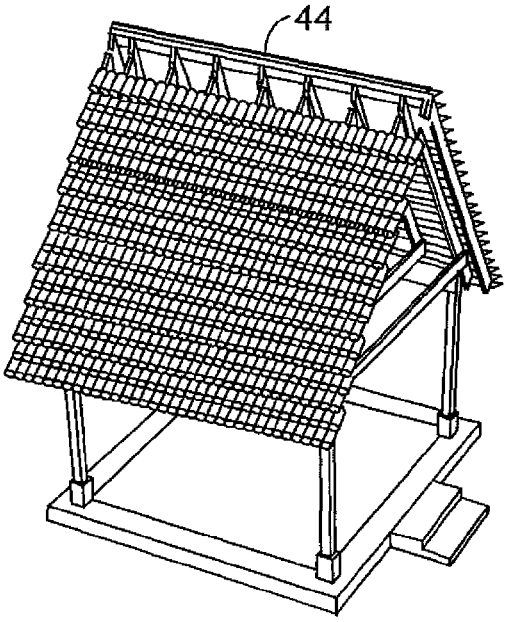

In practice, a framing means such as is shown in FIG. 4*a* is prepared by inserting the requisite number of BIBs thereon, followed by attachment of the thatching vessels. FIGS. 4*a*-4*c* illustrate this. Specifically, FIG. 4*a*, shows an embodiment 40 where interface brackets designed to hold four vessels 41 are aligned and attached to a purlin 42.

The cut bottles, as shown in FIG. 2*a*, are then attached to the purlin of FIG. 4*a* with the so-called "bottom thatch" being attached first, followed by the top thatch. Once these structures have been prepared, they are aligned on a roof structure, as shown in 43 of FIG. 4*b*, culminating in a complete roof structure, as per 44 of FIG. 4*c*.

One aspect of the invention relates to a kit useful in manufacturing a roof of the type described herein. Such a kit comprises, as separate components, a plurality of BIBs of the type described supra and examples of which are depicted in, e.g., FIGS. 1*b* and 1*d*, as well as attachments, such as that shown in 50 of FIG. 5*a*. Such attachments are standard in the art and may be used for attachment to, e.g., purlins or other supports useful in preparing a roof structure.

Also a part of such kits is a cutting means for cutting the vessels employed to make the roof. Again, such cutting means, exemplified by, e.g., 51*a*-51*d* of FIG. 5*b*, are well known and will be familiar to the skilled artisan.

In the kits of the invention, BIBs such as the embodiment shown in FIGS. 1*b* and 1*d* are attached to the purlin 52, or other support, as shown in FIG. 5*c*. Note that, in this embodiment, the BIBs include a pair of flared extensions 61, such that when paired with another bracket, the appropriate spacing therebetween can be determined by positioning the extensions so as to form a space that is identical to that of the cap of the vessels to be inserted into the brackets. This can also be seen in FIG. 6*a*, in greater detail.

As noted, supra, each BIB or bracket contains pre-set adjustable means for locking BIB interval sizes quickly. FIG. 6*b* shows these, via rows of circles 62 positioned at various points thereon. FIG. 6*c* is a close-up view of a portion of the BIB, showing how these adjustable means may be moved to accommodate vessels of different sizes.

The assembled supports, e.g., purlins 52 with brackets attached thereto, may then be positioned on pallets 53, or other supporting means, as shown in FIG. 5*d*, so that upon reaching the desired destination they can be assembled into a roof means using the attachment of FIG. 5*a* to set an appropriate slope for drainage, and attachment of vessels prepared "in situ."

The resulting structure is a lightweight, well ventilated, thermally conductive, and protective roof. For example, when rain strikes the roof it hits top thatch bottles, and slides down to the receiving, open end of a bottom thatch issue there under. The overlap between assemblies ensures the movement of water from one bottom thatch vessel, to the next. The mode of construction allows air trapped under the structure to escape, which in turn provides a surface which naturally and passively cools an enclosed, warm space.

Other aspects of the invention will be clear to the skilled artisan and need not be set forth herein.

The terms and expression which have been employed are used as terms of description and not of limitation, and there is no intention in the use of such terms and expression of excluding any equivalents of the features shown and described or portions thereof, it being recognized that various modifications are possible within the scope of the invention.

The invention claimed is:

1. A structural bracket useful for attaching a plurality of vessels having threaded necks, comprising a flat base, said flat base having attached thereto a plurality of threaded mounts, wherein each of said plurality of threaded mounts is configured to engage a single vessel of said plurality of vessels having a threaded neck, wherein said plurality of threaded mounts are adjustable within said flat base in both horizontal and vertical directions so that spacing between each of said plurality of threaded mounts may be changed.

2. The structural bracket of claim 1, wherein said plurality of threaded mounts includes from 2-6 threaded mounts.

3. The structural bracket of claim 1, wherein said structural bracket is constructed of recycled material.

4. A construction element useful in fabricating roofing means, comprising the structural bracket of claim 1, having attached thereto a first array of top thatch cavity containing vessels positioned in a row, said first array positioned above a second array of bottom thatch cavity containing vessels, said first array and second array containing an equal number of vessels of equal size.

5. The construction element of claim 4, wherein each cavity of each of said vessels contains an element to modulate light reception by said construction element.

6. A roof structure comprising a plurality of the construction element of claim 4, appended to a support means.

7. The roof structure of claim 6, wherein said support means is a purlin.

8. The roof structure of claim 6, comprising a frame structure with said support means positioned therein.

9. A kit useful in construction of a roofing means of disposable vessels, comprising:

(i) a plurality of the structural bracket of claim 1;

(ii) cutting means for preparing top thatch and bottom thatch vessels for use in said roofing means; and (iii) support means for attachment of the plurality of the structural bracket of claim 1 thereto.

* * * * *